United States Patent [19]

Yaeger et al.

[11] 4,316,367

[45] Feb. 23, 1982

[54] HEAT RECOVERY AND HOT WATER CIRCULATION SYSTEM

[76] Inventors: Ronald J. Yaeger, 5006 Millcreek, Dallas, Tex. 75234; Gerald W. Keller, 6853 Carolinecrest, Dallas, Tex. 75214

[21] Appl. No.: 949,083

[22] Filed: Oct. 6, 1978

[51] Int. Cl.[3] ..... F25B 27/02; F25B 13/00

[52] U.S. Cl. ..... 62/238.6; 62/324.4

[58] Field of Search ..... 62/117, 298, 299, 238 E, 62/324 D, 179, 180, 181; 126/362; 165/DIG. 2

[56] References Cited

U.S. PATENT DOCUMENTS

| | | | |
|---|---|---|---|
| 1,780,379 | 11/1930 | Durdin, Jr. | 126/362 |
| 1,874,803 | 8/1932 | Reed | 62/238 E |
| 2,143,287 | 1/1939 | Smith | 62/238 E |
| 2,515,974 | 7/1950 | Araldsen | 126/362 |
| 2,530,648 | 11/1950 | Cahenzli et al. | 62/514 |
| 2,690,649 | 10/1954 | Borgerd | 62/238 E |
| 3,096,021 | 7/1963 | Lintvedt | 126/362 |
| 3,301,002 | 1/1967 | McGrath | 62/238 E |
| 3,916,638 | 11/1975 | Schmidt | 62/238 E |
| 3,922,876 | 12/1975 | Wetherington et al. | 62/180 |
| 4,041,726 | 8/1977 | Mueller et al. | 62/238 |
| 4,089,667 | 5/1978 | Jonsson | 62/238 E |
| 4,098,092 | 7/1978 | Singh | 62/238 E |
| 4,103,510 | 8/1978 | Hall | 62/299 |
| 4,134,274 | 1/1979 | Johnsen | 62/179 |
| 4,141,222 | 2/1979 | Ritchie | 62/179 |
| 4,142,515 | 3/1979 | Skaats | 126/362 |

*Primary Examiner*—Lloyd L. King

[57] ABSTRACT

A heat recovery and hot water circulation system for use with refrigeration means and a hot water reservoir is disclosed. A hot water distribution conduit is coupled intermediate the cold water inlet and hot water outlet of the reservoir for supplying hot water to a remote station having a number of faucets coupled to the distribution conduit, and a pump is coupled to the distribution conduit for continuously circulating hot water to the faucets. A heat exchange circulation conduit is connected in parallel fluid circuit relation with the distribution conduit and in series fluid circuit relation with the pump. A heat exchanger couples the hot water reservoir to the compressor by means of its refrigerant passage and water passage which are mutually coupled in heat exchange relation, the refrigerant passage being connected in fluid communication with the discharge outlet of the compressor, and the water passage being coupled to the hot water reservoir by means of a heat exchange circulation conduit which permits water to be circulated from the reservoir through the heat exchanger. Valve means are connected in series fluid circuit relation with the heat exchange circulation conduit and is responsive to the operation of the compressor and to the temperature of the water circulated through the heat exchanger for permitting the circulation of water through the heat exchange conduit when the compressor is operating and the temperature of water circulated through the heat exchanger is less than a predetermined level, for example 160° F., and for preventing the circulation of water through the heat exchange circulation conduit when the temperature of the water exceeds the predetermined level or when the compressor is not operating.

2 Claims, 1 Drawing Figure

HEAT RECOVERY AND HOT WATER CIRCULATION SYSTEM

BACKGROUND OF THE INVENTION

1. Field of the Invention

The present invention relates to heat recovery systems, and in particular relates to such systems which recover the waste heat of air conditioning and refrigeration systems for purposes of heating water.

2. Description of the Prior Art

Because of the rapidly rising costs of energy, the incentives to conserve energy are increasing, both for industrial users and domestic users. Consequently there is currently considerable interest in not only eliminating energy waste by making equipment more efficient but also by recovering energy such as waste heat which according to conventional practice is usually injected into the atmosphere without recovery.

The potential for energy conservation by the recovery of waste heat in the home is substantial because of the amount of energy required to operate air conditioning equipment and hot water heating equipment, both of which are significant users of energy. For example, an air conditioning system with a water cooled condenser, while producing a ton of refrigeration or 12,000 BTUH of cooling capacity, also produces approximately 15,000 BTUH of heat which is rejected to the atmosphere. An air conditioning system with an air cooled condenser rejects about 16,000 to 17,000 BTUH for each ton or 12,000 BTUH of cooling capacity. Of this 15,000 to 17,000 BTUH of heat for each ton of capacity, 3,000 to 5,000 BTUH is relatively easy to recover at a very nominal expense. Generally, the refrigeration system is operated totally separate from the hot water system with the result that the heat removed in the condensing process of the refrigeration system is wasted, while the water in the hot water system is heated by means of an auxiliary energy source such as gas, electricity, or oil. The cost of such fuel or energy can be great particularly in situations where large amounts of hot water are required.

It is well known in the art to use some of the heat from the condensing process of a refrigeration system to produce hot water in a storage tank. Heat is reclaimed by installing a heat exchanger in the hot gas line between the compressor and the condenser of the air conditioning system. Water from the cold water supply to the water heater is circulated through the heat exchanger by means of a small circulating pump. A temperature regulating valve controls the flow of water leaving the heat exchanger and permits only water which exceeds a predetermined temperature to circulate through the heat exchanger. This basic arrangement has been used with success and is gaining widespread acceptance. There is continuing interest in improving this basic system to make it more efficient and responsive.

It may be demonstrated that a conservative estimate of the amount of heat energy which can be recovered in an air conditioning system is approximately 40% of the energy input. Therefore in a residence with a three ton air conditioner, as much as 15 to 25 gallons of hot water can be raised from 70° F. to 140° F. every hour the air conditioner is running. With a five ton air conditioner, as much as 25 to 40 gallons of hot water could be produced. During the hot summer months when the air conditioner is running fairly consistently, considerably more hot water will be produced than is required for the average household. Accordingly, it is desirable to provide a waste heat recovery system which can be utilized in combination with existing hot water and air conditioning equipment in which the amount of waste heat recovered is limited to the amount needed to satisfy actual hot water requirements.

SUMMARY OF THE INVENTION

It is, therefore, a principal object of the present invention to provide a heat recovery and hot water circulation system which can be utilized with an existing refrigeration or air conditioning system for producing hot water in which the hot water is produced intermittently according to actual hot water requirements rather than being produced continuously. According to this arrangement, the heat exchanger may be utilized to produce hot water for an existing standard size hot water heater without risk of exceeding its pressure and temperature rating while satisfying the hot water production requirements. This arrangement is commercially attractive in that it can be utilized in combination with existing air conditioning and water heating equipment without redesign.

In certain applications it is desirable to circulate hot water at a constant temperature to a remote point and return to the hot water reservoir. For example, in certain commercial applications it is desirable to circulate hot water in thermal relation with food serving trays in a cafeteria serving line and then return to the hot water storage tank. In the home environment, it is sometimes necessary to locate hot water faucets throughout the house at long distances away from the hot water tank. In this arrangement hot water can be made to be instantly available at each of the faucets by continuously circulating the hot water from the hot water heater to the faucets in return. In both of these examples, a substantial amount of heat is lost by radiation and conduction through the very long hot water circulation conduits. Because of the very large amount of waste heat available which can be recovered from the air conditioning process, and because of the intermittent operation of the heat recovery system of the invention, the lost heat associated with the continuous circulation of hot water to a remote point can be easily provided for without increasing the size of the existing water heater. That is, the additional hot water needed for servicing a remote station can be provided by a hot water reservoir of smaller capacity than would otherwise be required without the benefit of the heat recovery system of the invention.

These objects and advantages are carried out according to the present invention in a heat recovery and hot water circulation system for use with a refrigeration system or an air conditioning system having a compressor thermally coupled to a hot water reservoir such as a conventional hot water heater. The heat recovery and hot water circulation system comprises generally a heat exchanger having a refrigerant passage and a water passage mutually coupled in heat exchange relation with the refrigerant passage being connected in fluid communication with the discharge outlet of the compressor for receiving high pressure, heated refrigerant vapor. A hot water distribution conduit which may service a remote station is coupled intermediate the hot water outlet and cold water inlet of the hot water reservoir. A pump is coupled to the distribution conduit for continuously circulating hot water through the conduit to the remote station and return. A heat exchange circulation conduit is connected in parallel fluid circuit relation with the distribution conduit and the pump, with the heat exchange circulation conduit also connecting the heat exchanger water passage to the hot water reservoir to permit water to be circulated from the reservoir to the heat exchanger. A valve is connected in series fluid circuit relation with the heat exchange circulation conduit for selectively interrupting the circulation of water through the heat exchange circulation conduit when the temperature of the circulating water exceeds a predetermined level or when the compressor is not operating, and for admitting the flow of water through the circulation conduit when the compressor is operating and the temperature of the circulating water is less than the predetermined temperature level.

In a preferred embodiment, the valve is solenoid operated with the power for the solenoid being derived from the power to the compressor so that the solenoid can only operate when the compressor is running. In addition, operation of the solenoid is controlled by means of a temperature sensitive switch which is thermally coupled to water which is circulated through the water passage of the heat exchanger for closing the solenoid operated valve to prevent the flow of water through the heat exchange water passage when the temperature of the water circulated through the heat exchanger exceeds the predetermined temperature level. According to this arrangement, water will be continuously circulated through the distribution conduit to service a remote station, with heat exchange occurring only when the compressor is running and only when the temperature of the water in the water storage tank is less than a desired level.

The foregoing and other objects, advantages and features of the invention will hereinafter appear, and for purposes of illustration, but not of limitation, an exemplary embodiment of the subject invention is shown in the appended drawing.

BRIEF DESCRIPTION OF THE DRAWING

The sole FIGURE of the drawing is a schematic diagram of a combined heat recovery and water circulation system constructed according to the teachings of the invention.

DETAILED DESCRIPTION OF A PREFERRED EMBODIMENT

Figure 1:
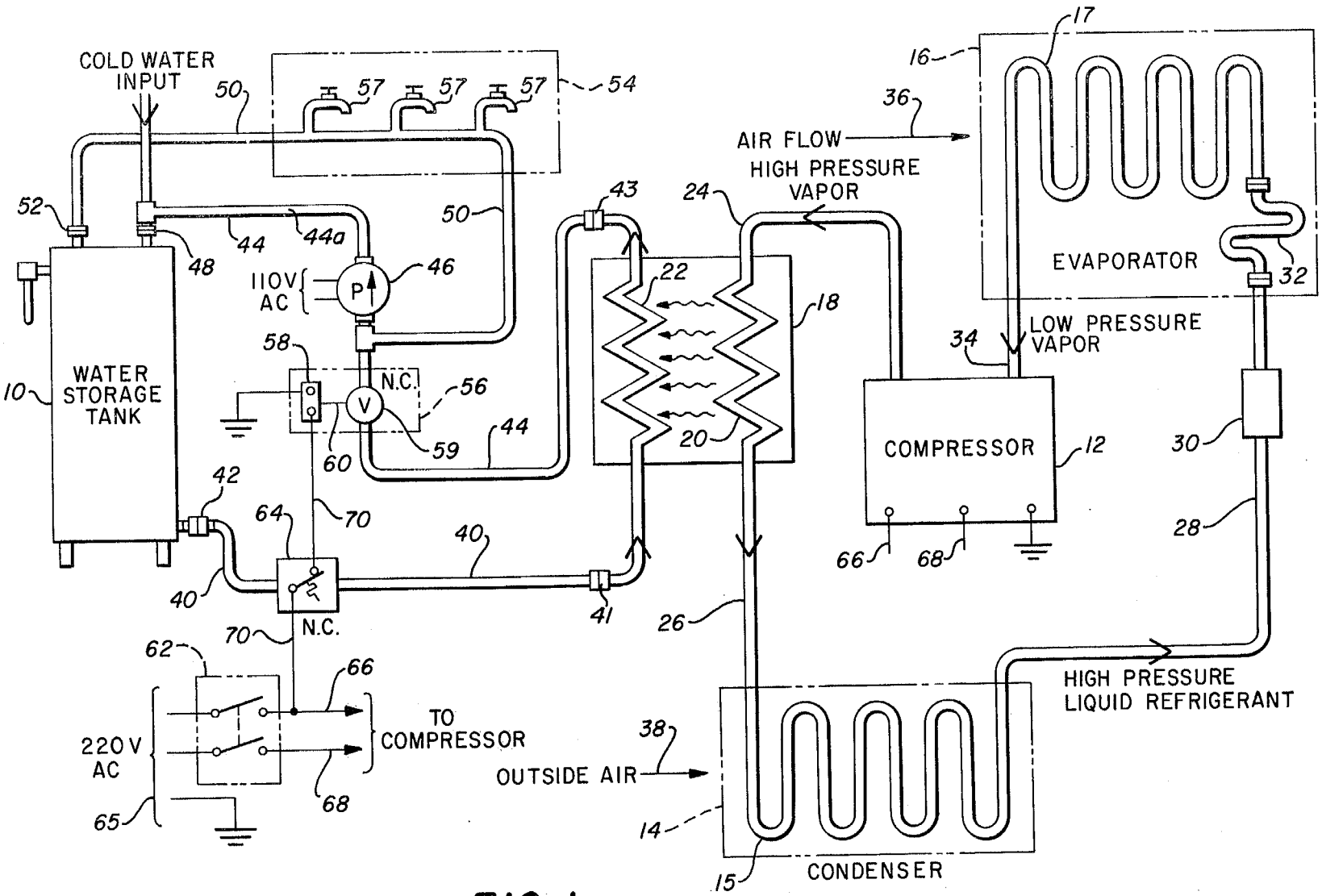

In the description which follows, like parts are marked throughout the specification and drawing with the same reference numerals, respectively.

Referring now to the drawing, the heat recovery and hot water circulation system of the invention includes a hot water reservoir 10 which may be of any conventional size, for example, a forty gallon hot water heater tank as commonly found in a residence, and an air conditioning system which includes a compressor 12, a condenser 14 and an evaporator 16. The compressor 12, condenser 14 and evaporator 16 are suitably interconnected to provide air conditioning for a residence. Air to be conditioned within the residence is brought into heat exchange relation with the evaporator 16 by means of suitable duct work (not shown) into the area being conditioned. Air is forced into heat exchange relation with the evaporator coil by means of a fan (not shown) in the conventional manner. An outside fan (not shown) brings outdoor air into heat exchange relation with the condenser 14.

The hot water circulation system and the air conditioning system are thermally coupled by means of a heat exchanger 18 which includes a refrigerant passage 20 and a water passage 22 which are mutually coupled in heat exchange relation. The refrigerant passage 20 is connected in fluid communication with the discharge outlet of the compressor 12 by means of a high pressure vapor conduit 24. A suitable refrigerant is circulated through the refrigerant passage 20 and is discharged into the condenser 14 through a condenser inlet conduit 26. The condenser 14 is connected in series fluid circuit relation with the evaporator 16 by means of a high pressure liquid refrigerant line 28. Prior to entering the evaporator 16, the refrigerant passes through a combination filter and dryer unit 30 which is connected in series fluid circuit communication with a capillary tube 32. Refrigerant is circulated through the evaporator and is discharged through a low pressure vapor suction line 34 where it enters the inlet port 35 of the compressor 12.

In operation, liquid refrigerant flows from the condenser 14 up through the high pressure liquid refrigerant line 28 to the combination filter/dryer 30. From the filter/dryer, the refrigerant flows through the capillary refrigerant control into the evaporator. The pressure of the liquid refrigerant as it enters the capillary tube at the filter end is at a high pressure, while the pressure in the evaporator 16 is at a low pressure. The design of the capillary tube 30 is such that it maintains a pressure difference while the compressor 12 is operating. The compressor maintains a low pressure in the evaporator coil 17, and the refrigerant boils rapidly thereby absorbing heat from the evaporator coils as air passes in heat transfer relation with the evaporator coils as indicated by the arrow 36. The vaporized refrigerant is drawn through the suction line 34 back to the compressor 12 where it is compressed to a high pressure and discharged through the refrigerant passage 20 of the heat exchanger and into the condenser coil 15 where it is cooled by the flow of outside air as indicated by the arrow 38 and returns to a liquid. Thus the liquid refrigerant absorbs heat while changing from its liquid state to a vapor state in the evaporator and gives up heat in changing from a vapor to a liquid in the condenser.

The heat exchanger 18 is preferably of the counterflow type for maximum heat transfer. The coaxial or tube-in-tube heat exchanger has proven very satisfactory. This type of heat exchanger consists of one or more assemblies of two tubes, one within the other, in which the hot gas refrigerant is conveyed through the outer tube with water flowing in the inner tube. These heat exchangers are sold commercially as water cooled refrigerant condensers by a number of refrigerant supply houses. Manufacturers of the tube-in-tube condensers and model numbers commonly available are Edwards Engineering Corporation, Model "S", Halstead Mitchell Company series E. L. and Dunham-Bush series CICB. A heat exchanger unit 18 manufactured specifically for this application is provided by Air and Refrigeration Corporation of Irving, Tex., under Model No. HX-40.

The heat exchanger 18 is preferably sized to impose a very small resistance to the flow of the refrigerant to minimize the pressure drop across the heat exchanger to minimize the interference with the operation of the capillary tube 32 and evaporator coil 17. Because the high pressure vapor discharge from the compressor 12 has been heated above its boiling point, it is said to be super heated and the super heat energy may be removed from the vaporized refrigerant in the heat exchanger without disturbing the pressure balances in the air conditioning system. Therefore the heat exchanger 18 is preferably sized with a BTU rating which will effectively remove the superheat from the high pressure refrigerant vapor with substantially all of the condensation taking place in the condenser 14. According to this arrangement, the high pressure refrigerant vapor discharged from the refrigerant passage 20 of the heat exchanger into the condenser is preferably substantially at its boiling point as it enters the condenser. As it has been previously pointed out approximately 40% of the BTU input can be recovered so that it is not necessary to recover latent heat or sensible heat associated with condensation of the high pressure refrigerant vapor. The advantage of this arrangement is that a more than adequate supply of heat energy is available for heating the water and that it can be connected within an existing air conditioning system without disturbing the pressure balances within the system.

A heat exchange circulation conduit 40 connects the water passage 22 of the heat exchanger in series fluid circuit relation with the water storage tank 10. One end of the heat exchange circulation conduit 40 is coupled to the water storage tank at a drain coupling 42 and the opposite end is connected to a coupling member 41 of the water passage 22. Water flows from the water storage tank 10 through the conduit 40 and through the water passage 22 in counterflow relation with respect to the flow of refrigerant through the refrigerant passage 20. The opposite end of the water passage 22 is coupled to a return conduit 44 in which a pump 46 is connected in series fluid circuit relation for effecting the circulation of water from the water storage tank 10 through the water passage 22 of the heat exchanger 18. One end of the return conduit 44 is connected to the coupling member 43 of the water passage 22 and the opposite end is coupled to the tank 10, preferably to the cold water inlet port 48. According to this arrangement, water in the storage tank 10 is thermally stratified with relatively cold water being withdrawn through the drain coupling 42. The relatively cold water is heated as it is circulated through the water passage 22 of the heat exchanger and then is discharged into the top of the water storage tank. The pump 46 is preferably of the water lubricated, fractional horsepower type having a rating of 1/35 horsepower and a power requirement of 110 volts AC. An example of a suitable pump is Grundfos UM25-18SU.

A hot water distribution conduit 50 is coupled to a hot water outlet port 52 of the water storage tank 10 for supplying water to a remote station which may include a number of hot water faucets 57 in various parts of a residence, for example. Because of the long run of the hot water distribution conduit 50 from the hot water storage tank to the faucets 57, the hot water may cool substantially because of heat transfer due to conduction and radiation. When this occurs, the relatively cool water must be withdrawn before hot water is available, representing an inconvenience and a waste of water. Therefore it is desirable to continuously circulate hot water from the hot water storage tank 10 through the hot water distribution conduit 50 so that hot water is instantly available at the remote station 54 without delay and without waste. According to the invention, the hot water distribution conduit 50 is connected in parallel relation with the pump 46 whereby hot water is continuously circulated from the hot water outlet port 52 through the remote station 54 through the return conduit portion **44*a* and into the cold water inlet port 48. To carry out this function, it is essential that the pump 46** operate continuously.

As has been previously pointed out, during operation of the air conditioning system during the warm summer months, more heat will be recovered than can be utilized in the average residence. Accordingly, it is desirable to decouple the hot water circulation system from the air conditioning system when an adequate supply of hot water at a desired temperature is available in the water storage tank 10. According to the invention, this function is carried out by means of a solenoid operated valve assembly 56 which includes a valve 59 connected in series fluid circuit relation with the return conduit 44, an electrical solenoid 58 and an actuator element 60 for opening and closing the valve 58. It is preferred that the valve 59 be "normally closed" when the solenoid 58 is deenergized, thereby interrupting the circulation of water through the water passage 22 of the heat exchanger 18. Operation of the solenoid is controlled by the operation of a power switch assembly 62 which controls the application of electrical power to the compressor 12, and by a temperature sensitive switch 64 which is connected in thermal relation with water flowing through the heat exchange circulation conduit 40. According to this arrangement, the solenoid is energized by closure of the power switch assembly 62 which energizes power conductors 66, 68 connected to the compressor 12. Current for actuating the solenoid 58 flows through a control conductor 70 through the temperature sensitive switch 64 to the solenoid 58.

The temperature sensitive switch is thermally coupled to water which is circulated through the heat exchanger and is electrically coupled to the solenoid 58 and to the power circuit 65 for opening the valve 59 when the compressor 12 is energized and the temperature of the water circulated through the heat exchanger is less than a predetermined level, for example 160° F., and for closing the valve 59 to permit the flow of water through the heat exchanger water passage 22 when the temperature of the water circulated through the heat exchanger exceeds the predetermined level or when the compressor 12 is deenergized. The carry out this function, the temperature sensitive switch 64 is normally closed and opens only when the temperature it senses exceeds the predetermined level. An example of a suitable temperature sensitive switch is ThermODisc styled 27276 by ThermODisc, Inc., which is a division of Emerson Electric Company. An example of a suitable solenoid valve is type 8211D95 produced by Automatic Switch Company of Floram Park, N.J.

With this arrangement, it will be seen that heat exchange can take place only when the compressor 12 is operating, thereby conserving the heated water in the storage tank 10. Otherwise, a substantial amount of heat would be lost unnecessarily because of circulation of warm water from the storage tank 10 through the conduits 40, 44 and heat exchanger by conduction and radiation, without benefit of heat transfer from the high pressure refrigerant vapor. Additionally, when the compressor is running and water is being circulated in heat transfer relation through the heat exchanger 18, the temperature sensitive switch 64 will open to deenergize the solenoid 58 and thereby interrupt the flow of water through the heat exchanger when the temperature of the water circulating through the conduit 40 reaches a desired operating temperature thereby eliminating the possibility of exceeding the temperature and pressure limits of the hot water storage tank 10.

The circulation conduit 40 and return conduit 44 are preferably larger in diameter than the hot water distribution conduit 50 so that while the compressor 12 is running and the valve 59 is open, most of the flow from the heat exchanger passage 22 will pass through the return conduit 44, with very little flow passing through the hot water distribution conduit 50.

Although a preferred embodiment of the invention has been described in detail, it should be understood that various changes, substitutions and alterations can be made therein without departing from the spirit and scope of the invention as defined by the appended claims.

What is claimed is:

1. In a heat recovery system for recovering waste heat from refrigeration means to heat water supplied to a hot water reservoir, said system including heat exchange means having a refrigerant passage and a water passage mutually coupled in heat exchange relation, said refrigeration means including a compressor having an outlet coupled to said refrigerant passage, the improvement comprising:

(a) first conduit means in fluid communication with said water passage and coupled between an inlet to said hot water reservoir and an outlet from said hot water reservoir, thereby to define a first flow path for water to flow from said reservoir, through said heat exchange means, and thereafter into said reservoir;

(b) second conduit means coupled between another outlet from said hot water reservoir and a portion of said first conduit, thereby to define a second flow path for water to flow from said reservoir, through a portion of said first flow path, and thereafter into said reservoir through said inlet;

(c) a plurality of faucets coupled to said second conduit means;

(d) continuously running pump means disposed within the common portion of said first and second flow paths; and (e) valve means disposed within said first conduit means actuated to a first position for closing off the flow from said water passage when the water temperature in said water passage is above a predetermined level and actuated to a second position for enabling the flow from said water passage when the water temperature in said water passage is below a predetermined level.

2. The improvement as defined by claim 1 wherein said valve means is actuated to said second position when said compressor is energized.

* * * * *